US011017749B2

(12) United States Patent
Tsuzuku et al.

(10) Patent No.: US 11,017,749 B2
(45) Date of Patent: May 25, 2021

(54) TOUCH WEIGHT ADJUSTMENT MECHANISM FOR KEYBOARD DEVICE

(71) Applicant: KABUSHIKI KAISHA KAWAI GAKKI SEISAKUSHO, Hamamatsu (JP)

(72) Inventors: Hanayo Tsuzuku, Hamamatsu (JP); Yasushi Terai, Hamamatsu (JP); Mikhail Vasilievich Pletnev, Basel (CH)

(73) Assignee: KABUSHIKI KAISHA KAWAI GAKKI SEISAKUSHO, Hamamatsu (JP)

( * ) Notice: Subject to any disclaimer, the term of this patent is extended or adjusted under 35 U.S.C. 154(b) by 0 days.

(21) Appl. No.: 16/821,569

(22) Filed: Mar. 17, 2020

(65) Prior Publication Data

US 2020/0302898 A1 Sep. 24, 2020

(30) Foreign Application Priority Data

Mar. 19, 2019 (JP) ..... JP2019-050661

(51) Int. Cl.
*G10C 3/12* (2006.01)
*G10H 1/34* (2006.01)

(52) U.S. Cl.
CPC ..... *G10C 3/12* (2013.01); *G10H 1/346* (2013.01)

(58) Field of Classification Search
CPC ..... G10C 3/12; G10H 1/346
See application file for complete search history.

(56) References Cited

U.S. PATENT DOCUMENTS

| | | | | | |
|---|---|---|---|---|---|
| 406,913 | A * | 7/1889 | Ivers | G10C 3/12 | 84/440 |
| 727,348 | A * | 5/1903 | Goggan | G10C 3/12 | 84/440 |
| 1,840,712 | A * | 1/1932 | Grant | G10B 1/04 | 84/424 |
| 2,466,511 | A * | 4/1949 | Swanson | G10C 3/12 | 84/434 |
| 2,764,907 | A * | 10/1956 | Link | G10C 3/12 | 84/434 |
| 2,773,408 | A * | 12/1956 | Dvorak | G10C 3/26 | 84/217 |

(Continued)

FOREIGN PATENT DOCUMENTS

JP 58-91789 6/1983

*Primary Examiner* — Robert W Horn
(74) *Attorney, Agent, or Firm* — Lewis Roca Rothgerber Christie LLP

(57) ABSTRACT

A touch weight adjustment mechanism for a keyboard device, which is capable of adjusting a touch weight of a key easily and appropriately by using a coil spring and changing the urging force of the spring. An adjustment spring is formed by a coil spring for causing a tensile force thereof to act on the key, thereby increasing the touch weight of the key. An adjustment shaft is formed in a rod shape and is movable in a lengthwise direction by being operated for rotation. A rotary connection member connects between one end of the adjustment spring and one end of the adjustment shaft, which are closest to each other, and a spring-side connecting portion thereof connected to the adjustment spring and a shaft-side connecting portion thereof connected to the adjustment shaft are rotatable relative to each other.

7 Claims, 6 Drawing Sheets

(56) References Cited

U.S. PATENT DOCUMENTS 2,999,411 A * 9/1961 Rice ..... G10H 1/34 84/439
3,026,760 A * 3/1962 Fauser ..... G10C 3/12 84/423 R
3,165,965 A * 1/1965 Lo Duca ..... G10C 3/12 84/435
3,330,176 A * 7/1967 Schwartz ..... G10C 3/12 84/433
3,413,885 A * 12/1968 Van Der Lely ..... G10H 1/344 84/435
3,447,414 A * 6/1969 Duca ..... G10C 3/12 84/436
3,654,831 A * 4/1972 Grilli ..... E05D 7/081 84/435
3,903,780 A * 9/1975 Aliprandi ..... G10C 3/12 84/433
4,044,646 A * 8/1977 Invernati ..... G10C 3/12 84/435
4,364,297 A * 12/1982 Meier ..... G10H 1/344 84/433
4,512,234 A * 4/1985 Kumano ..... G10H 1/344 84/433
4,604,937 A * 8/1986 Kumano ..... G10H 1/344 84/434
4,653,378 A * 3/1987 Watanabe ..... G10H 1/348 84/366
4,890,533 A * 1/1990 Katsuta ..... G10C 9/00 84/439
4,896,577 A * 1/1990 Trivelas ..... G10C 3/24 84/240
4,899,631 A * 2/1990 Baker ..... G10H 1/053 84/433
5,036,743 A * 8/1991 Yamaguchi ..... G10H 1/344 84/434
5,079,985 A * 1/1992 Yamaguchi ..... G10C 3/12 84/719
5,090,290 A * 2/1992 Kumano ..... G10H 1/344 84/434
5,249,497 A * 10/1993 Niitsuma ..... G10C 3/12 84/247
5,323,679 A * 6/1994 Riday ..... G10C 3/12 84/423 R
RE35,161 E * 2/1996 Kumano ..... G10C 3/12 84/434
5,505,115 A * 4/1996 Vandervoort ..... G10H 1/28 84/423 R
5,571,983 A * 11/1996 Yamaguchi ..... G10H 1/346 84/745
5,610,352 A * 3/1997 Yamaguchi ..... G10C 3/12 84/251
5,866,831 A * 2/1999 Kimble ..... G10H 1/346 84/433
5,894,099 A * 4/1999 Niitsuma ..... G10C 3/12 84/430
5,895,875 A * 4/1999 Osuga ..... G10H 1/346 84/423 R
5,959,228 A * 9/1999 Yamaguchi ..... G10H 1/344 84/433
7,176,370 B2 * 2/2007 Osuga ..... G10C 3/12 84/423 R
7,217,877 B2 * 5/2007 Funaki ..... G10C 3/12 84/433
8,889,975 B2 * 11/2014 Komatsu ..... G10H 1/346 84/439
9,040,807 B2 * 5/2015 Osuga ..... G10H 1/346 84/744
9,576,559 B1 * 2/2017 Morong ..... G10B 3/12
10,847,130 B2 * 11/2020 Terai ..... G10H 1/346
2003/0183066 A1 * 10/2003 Gallitzendorfer ..... G10H 1/346 84/745
2020/0302898 A1 * 9/2020 Tsuzuku ..... G10H 1/346

* cited by examiner

TOUCH WEIGHT ADJUSTMENT MECHANISM FOR KEYBOARD DEVICE

CROSS-REFERENCE TO RELATED APPLICATION(S)

This application claims priority to Japanese Patent Application Number 050661/2019, filed on Mar. 19, 2019, the entire contents of which are incorporated herein by reference.

BACKGROUND OF THE INVENTION

Field of the Invention

The present invention relates to a touch weight adjustment mechanism for a keyboard device, which is applied to a keyboard instrument, such as an electronic piano, and is used to adjust a touch weight felt at a fingertip during depression of a key.

Description of the Related Art

Conventionally, as a touch weight adjustment mechanism of the above-mentioned kind, there has been known one disclosed e.g. in Japanese Laid-Open Utility Model Publication (Kokai) No. S58-91789. In this touch weight adjustment mechanism, there is provided a spring extending vertically between a rear end of a key extending in a front-rear direction and a chassis disposed below the key and pivotally supporting the rear end of the key, and an adjustment portion to which is fixed the lower end of the spring is vertically movably disposed with respect to the chassis. With this construction, in a case where the adjustment portion is moved upward, a force urging the key from below is increased, which causes an increase in touch weight felt during depression of the key. On the other hand, when the adjustment portion is moved downward, the force urging the key from below is reduced, which causes a decrease in the touch weight of the key.

In the above-described conventional touch weight adjustment mechanism, as adjustment means for vertically moving the adjustment portion to which the lower end of the spring is fixed, there is disclosed the use of a sloped surface or a screw by way of example. However, in the case of the adjustment means making use of a sloped surface, it is required to dispose a member having the sloped surface under the adjustment portion, for example, and configure the member such that the member can be moved horizontally and also can be held at a desired position, which complicates the structure of the adjustment means.

On the other hand, in the case of the adjustment means making use of a screw, by screwing the screw into the chassis, it is possible to not only move the tip end of the screw vertically, but also hold the screw in a position where the same is screwed. However, e.g. when the above-described spring is a coil spring and the lower end thereof is directly connected to the upper end of the screw, there is a fear that the spring is twisted in accordance with rotation of the screw, causing the urging force of the spring to be hindered from appropriately acting on the key. Further, since the spring is a compression spring, buckling can occur, and in this case as well, the urging force of the spring is hindered from appropriately acting on the key.

SUMMARY OF THE INVENTION

It is an object of the present invention to provide a touch weight adjustment mechanism for a keyboard device, which is capable of adjusting a touch weight of a key easily and appropriately by using a coil spring and changing the urging force of the spring.

To attain the above object, the present invention provides a touch weight adjustment mechanism for a keyboard device including a plurality of keys, which is configured to adjust touch weight of an associated one of the keys, comprising an adjustment spring formed by a coil spring and configured to cause a tensile force thereof to act on the key, thereby increasing the touch weight of the key, an adjustment shaft formed in a rod shape and configured to be movable in a lengthwise direction thereof by being operated for rotation, and a rotary connection member provided so as to connect between one end of the adjustment spring and one end of the adjustment shaft, which are closest to each other, and configured such that a spring-side connecting portion thereof connected to the adjustment spring and a shaft-side connecting portion thereof connected to the adjustment shaft are rotatable relative to each other.

With this construction, the touch weight adjustment mechanism for a keyboard device including a plurality of keys includes the adjustment spring, the adjustment shaft, and the rotary connection member. The adjustment spring formed by a coil spring is configured to cause its tensile force to act on the associated key to thereby increase the touch weight of the key, whereas the adjustment shaft formed in a rod shape is configured to be movable in the lengthwise thereof direction by being operated for rotation. Further, the one end of the adjustment spring and the one end of the adjustment shaft, which are closest to each other, are connected to each other via the rotary connection member.

When the adjustment shaft is operated for rotation, it is moved e.g. in a direction away from the adjustment spring to thereby increase the tensile force of the adjustment spring, so that the urging force of the adjustment spring on the key (i.e. the urging force against depression of the key) increases to increase the touch weight of the key. On the other hand, when the adjustment shaft, operated for rotation, is moved e.g. in a direction toward the adjustment spring to thereby decrease the tensile force of the adjustment spring, the urging force of the adjustment spring on the key decreases, contrary to the above, to decrease the touch weight of the key. In other words, the urging force of the adjustment spring on the key is changed by operating the adjustment shaft for rotation, to increase or decrease the tensile force of the adjustment spring, whereby it is possible to increase or decrease the touch weight of the key. Further, the rotary connection member is provided between the adjustment spring and the adjustment shaft, and the spring-side connecting portion and the shaft-side connecting portion of the rotary connection member can rotate relative to each other, so that even when the adjustment shaft is operated for rotation, the rotational motion of the adjustment shaft is not transmitted to the adjustment spring. What is more, differently from the spring of the conventional touch weight adjustment mechanism described hereinbefore, the adjustment spring is formed by a tensile spring, and hence it is possible to adjust the tensile force of the adjustment spring appropriately. As described above, the present invention makes it possible to adjust the touch weight of the key easily and appropriately by using the adjustment spring formed by a coil spring and changing the urging force of the adjustment spring.

Preferably, in the keyboard device, each of the keys is supported above a base via a predetermined linkage from below and is configured to be vertically movable; the adjustment spring extends vertically and has an upper end thereof connected to a predetermined site of the linkage, the adjustment spring being configured to urge the predetermined site downward in accordance with depression of the key to thereby increase the touch weight of the key supported by the linkage; the adjustment shaft extends vertically and is disposed in a state inserted vertically through the base, the adjustment shaft being configured to be vertically movable by having a portion thereof protruding outward from the base, operated for rotation; and the rotary connection member connects between a lower end of the adjustment spring and an upper end of the adjustment shaft.

With the construction of this preferred embodiment, in the keyboard device having the plurality of keys, each of the keys is supported above the base via the predetermined linkage from below and is configured to be vertically movable. Further, the adjustment spring, which extends vertically, has the upper end thereof connected to the predetermined site of the linkage, whereas the adjustment shaft, which extends vertically, is disposed in a state inserted vertically through the base and is configured to be vertically movable by being operated for rotation. Furthermore, the rotary connection member connects between the lower end of the adjustment spring and the upper end of the adjustment shaft.

When the adjustment shaft is operated for rotation to move downward, for example, to thereby increase the tensile force of the adjustment spring, the downward urging force on the predetermined site of the linkage is increased, resulting in an increase in the touch weight of the key. On the other hand, when the adjustment shaft is operated for rotation to move upward to thereby decrease the tensile force of the adjustment spring, the downward urging force on the predetermined site of the linkage is reduced, resulting in a decrease in the touch weight of the key. As described above, simply by operating the vertically extending adjustment shaft for rotation, it is possible to easily change the downward urging force on the predetermined site of the linkage to thereby adjust the touch weight of the key with ease.

More preferably, the adjustment shaft is loosely inserted through a through hole formed in the base and has a male screw formed on an outer peripheral surface of a lower portion thereof and an engaging portion, with which a tool for rotating operation can be engaged, formed on a lower end thereof, and the touch weight adjustment mechanism further includes a nut disposed on an outside of the base for engagement with the male screw of the adjustment shaft.

With the construction of this preferred embodiment, the adjustment shaft is loosely inserted through the through hole formed in the base, and the male screw formed on the outer peripheral surface of the lower portion of the adjustment shaft is screwed into the nut disposed on the outside of the base. Further, the engaging portion with which a tool for rotating operation can be engaged is formed on the lower end of the adjustment shaft. Therefore, in the case of operating the adjustment shaft for rotation, by turning the tool in a state in which the tool is engaged with the engaging portion formed on the lower end of the adjustment shaft, it is possible to vertically move the adjustment shaft screwed in the nut, with ease.

More preferably, the adjustment shaft has a male screw formed on an outer peripheral surface thereof and screwed in a screw hole formed in the base, and has an engaging portion, with which a tool for rotating operation can be engaged, formed on a lower end thereof.

With the construction of this preferred embodiment, the adjustment shaft has the male screw formed on the outer peripheral surface thereof and the male screw is screwed in the screw hole formed in the base. Further, the engaging portion with which a tool for rotating operation can be engaged is formed on the lower end of the adjustment shaft. Therefore, in the case of operating the adjustment shaft for rotation, by turning the tool in a state engaged with the engaging portion of the lower end of the adjustment shaft, it is possible to vertically move the adjustment shaft screwed in the screw hole formed in the base, with ease.

Preferably, the rotary connection member is formed by a swivel.

In general, swivels are manufactured e.g. as a kind of fishing gear at a relatively low cost and in quantity. Therefore, by using a swivel for the rotary connection member, it is possible to obtain the rotary connection member with relative ease and at a low cost.

Preferably, the keyboard device is formed by a plurality of keyboard units each of which has a predetermined number of keys included in the plurality of keys and which are configured to be separable from each other.

With the construction of this preferred embodiment, the keyboard device is formed by the plurality of keyboard units each having a predetermined number of keys, and the keyboard units are configured to be separable from each other. Therefore, when adjusting the touch weight of a key, by vertically inverting an associated keyboard unit and thereby hold the keyboard unit in a position for easy access by a tool, it is possible to operate the associated adjustment shaft for rotation e.g. from above. This makes it possible to carry out work for touch weight adjustment with relative ease.

Preferably, in the keyboard device, each of the keys extends above a base in a front-rear direction and is configured to be pivotally movable about a predetermined location in a lengthwise direction thereof as a pivot; the adjustment spring extends vertically and has an upper end thereof connected to a predetermined site of the key, located rearward of the pivot, the adjustment spring being configured to urge the predetermined site downward in accordance with depression of the key to thereby increase the touch weight of the key; the adjustment shaft extends vertically and is disposed in a state inserted vertically through the base, the adjustment shaft being configured to be vertically movable by having a portion thereof protruding outward from the base, operated for rotation; and the rotary connection member connects between a lower end of the adjustment spring and an upper end of the adjustment shaft.

With the construction of this preferred embodiment, in the keyboard device having the plurality of keys, each of the keys extends in the front-rear direction above the base and is configured to be pivotally movable about the predetermined location in the lengthwise direction thereof as the pivot. Further, the adjustment spring extending vertically has the upper end thereof connected to the predetermined site of the key, located rearward of the pivot, whereas the adjustment shaft extending vertically is disposed in a state inserted vertically through the base and is configured to be vertically movable by having the portion thereof projecting outward from the base operated for rotation. Furthermore, the rotary connection member connects between the lower end of the adjustment spring and the upper end of the adjustment shaft.

When the adjustment shaft is operated for rotation to move downward, for example, to thereby increase the tensile force of the adjustment spring, the downward urging force on the predetermined site of the key rearward of the pivot is increased, resulting in an increase in the touch weight of the key. On the other hand, when the adjustment shaft is operated for rotation to move upward to thereby decrease the tensile force of the adjustment spring, the downward urging force on the predetermined site of the key is reduced, resulting in a decrease in the touch weight of the key. As described above, simply by operating the vertically extending adjustment shaft for rotation, it is possible to easily change the downward urging force on the predetermined site of the key to thereby adjust the touch weight of the key with ease.

The above and other objects, features, and advantages of the present invention will become more apparent from the following detailed description taken in conjunction with the accompanying drawings.

BRIEF DESCRIPTION OF THE DRAWINGS

FIGS. 7A and 7B are views useful in explaining adjustment operation of the touch weight adjustment mechanism, in which FIG. 7A shows a state in which adjustment has been performed so as to reduce touch weight, and FIG. 7B shows a state in which adjustment has been performed so as to increase touch weight.

DETAILED DESCRIPTION OF PREFERRED EMBODIMENTS

Figure 1:
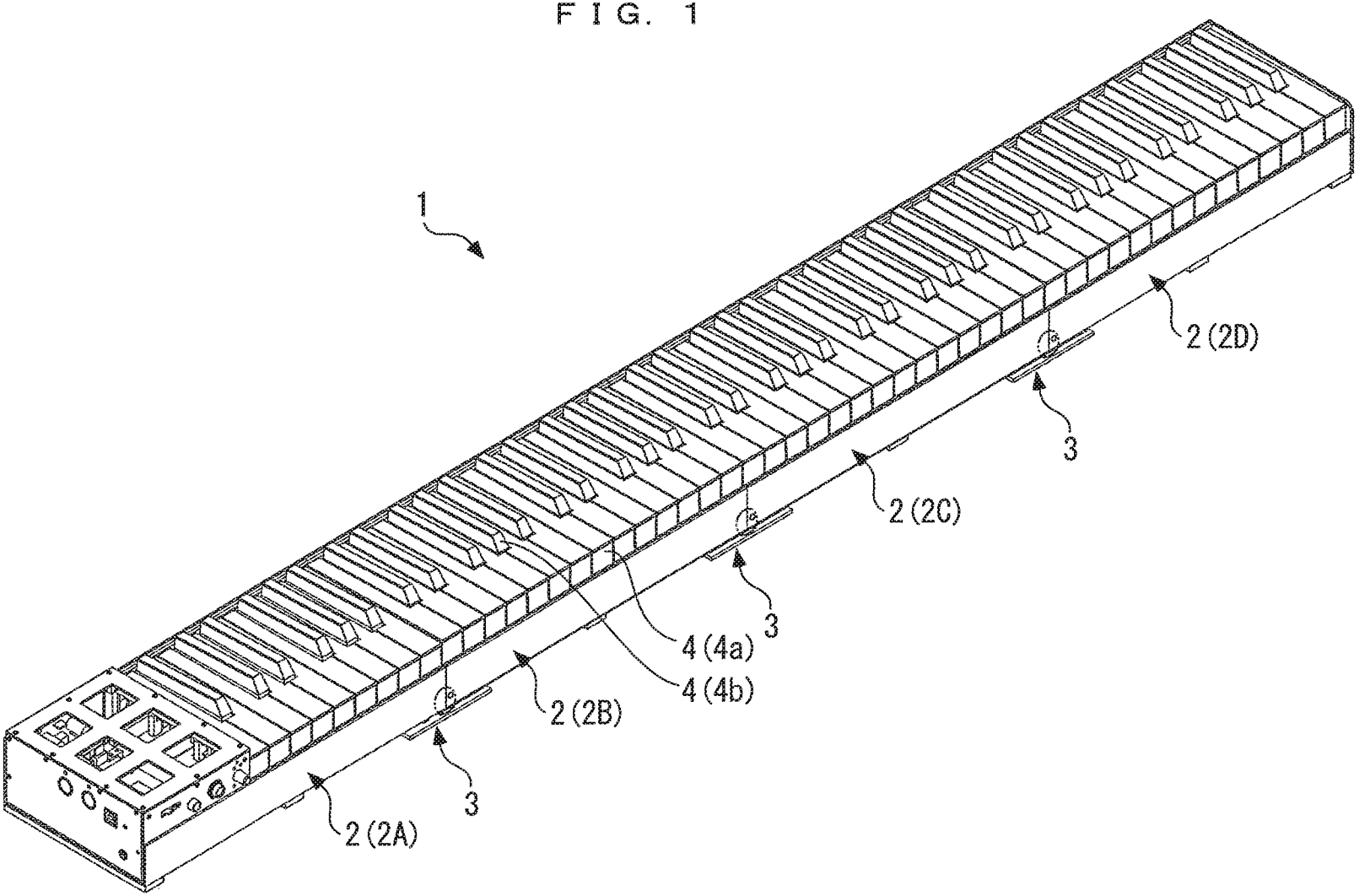
FIG. 1 is a perspective view of the appearance of a keyboard device to which is applied a touch weight adjustment mechanism according to an embodiment of the present invention.

The present invention will now be described in detail with reference to the drawings showing preferred embodiments thereof. FIG. 1 shows a keyboard device to which is applied a touch weight adjustment mechanism according to an embodiment of the present invention. This keyboard device 1 is used for an electronic piano and is comprised of a plurality (four in the present embodiment) of keyboard units 2 which are configured to be separable from each other.

Figure 2:
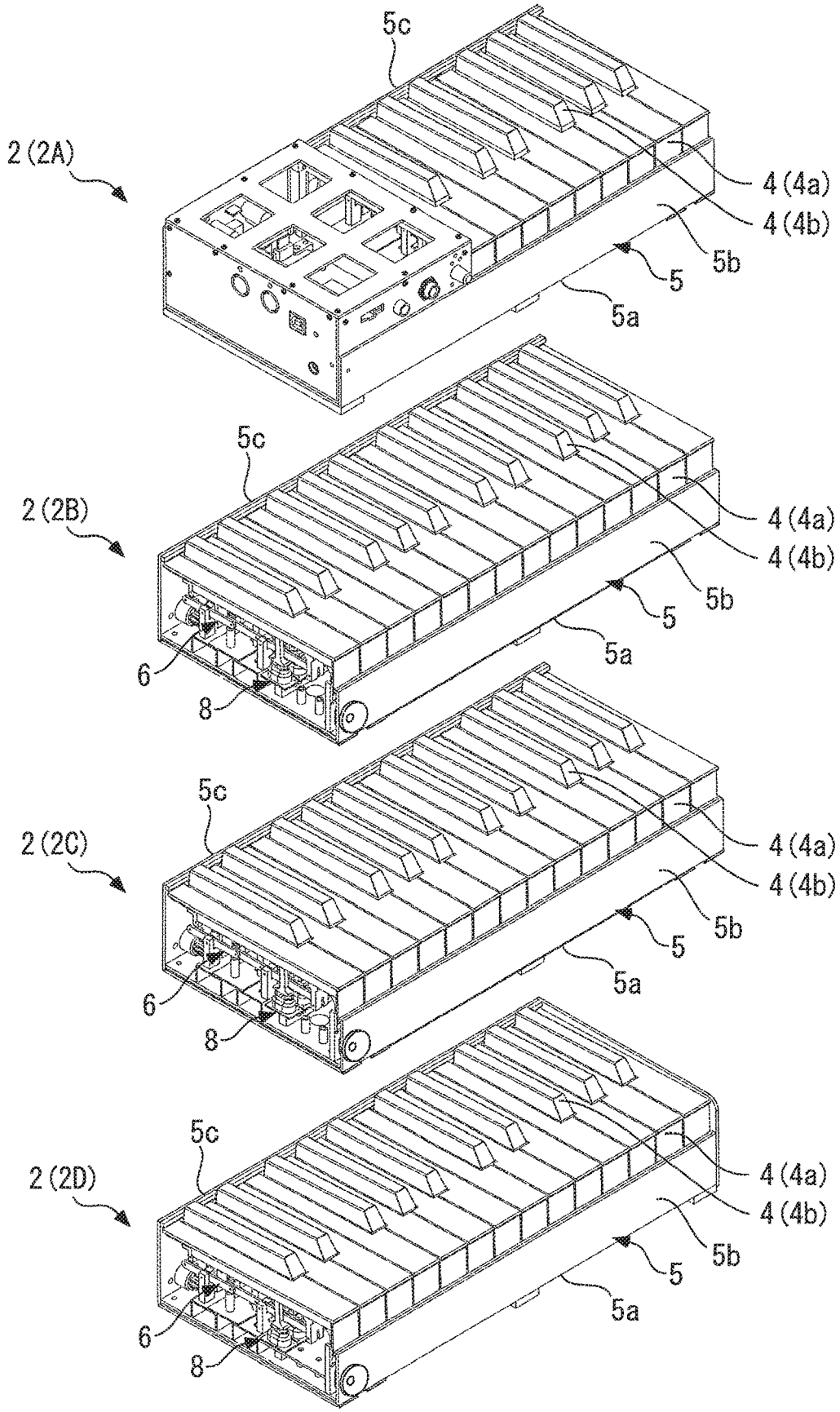
FIG. 2 is a perspective view of the FIG. 1 keyboard device in a state exploded into four keyboard units.

FIG. 2 shows the keyboard device 1 in a state separated into the four keyboard units 2. As shown in FIGS. 1 and 2, the keyboard device 1 is comprised of the four keyboard units 2 corresponding to a low-pitched sound range, a lower middle-pitched sound range, a higher middle-pitched sound range, and a high-pitched sound range, respectively, and three connection plates 3 for connecting the keyboard units to each other. Note that in the following description, when it is required to distinguish the four keyboard units 2 according to the sound ranges, they will be referred to as "the low-pitched sound unit 2A", "the lower middle-pitched sound unit 2B", "the higher middle-pitched sound unit 2C", and "the high-pitched sound unit 2D", respectively.

Each of the keyboard units 2 has a plurality of keys 4 (white keys 4*a* and black keys 4*b*) each extending in the front-rear direction over a predetermined length and arranged side by side in the left-right direction and a unit case 5 so disposed as to surround the lower sides of the keys 4. The low-pitched sound unit 2A is provided with keys 4 (15 keys in the present embodiment) corresponding to approximately one octave, and each of the lower middle-pitched sound unit 2B, the higher middle-pitched sound unit 2C, and the high-pitched sound unit 2D is provided with keys 4 (24 keys in the present embodiment) corresponding to two octaves. Note that although in the present embodiment, the keyboard device 1 has 87 keys fewer than the keys (88 keys) of a general piano by one key, if the keyboard device 1 is configured to have 88 keys similarly to the general piano, the high-pitched sound unit 2D is configured to be provided with 25 keys.

Figure 3A:
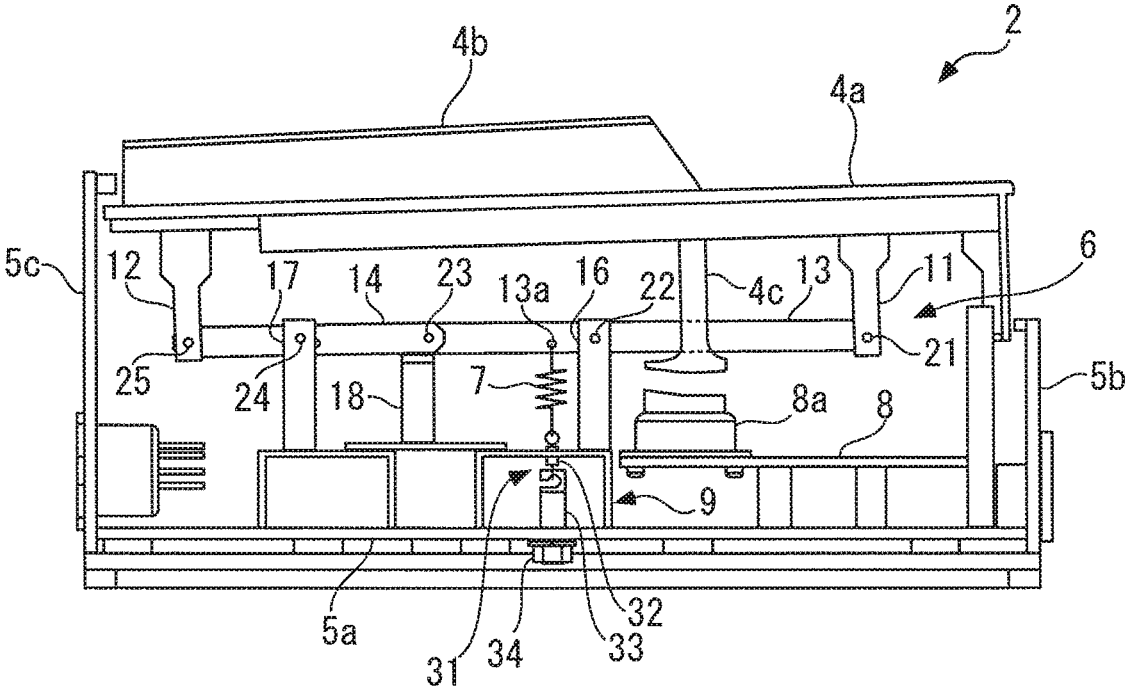
FIG. 3A is a side view of a keyboard unit in a key-released state.

FIG. 3A is a side view of the keyboard unit 2 in a key-released state. As shown in FIGS. 2 and 3A, the unit case 5 is formed by a bottom board 5*a* (base) having a laterally elongated rectangular shape in plan view, and a front panel 5*b* and a rear panel 5*c* erected perpendicular to the bottom board 5*a* from the respective front end and rear ends of the same, such that the unit case 5 has a U-shaped cross-section opening upward. Within the unit case 5, there are provided a plurality of linkages 6 (only one of which is shown in FIG. 3A) each disposed such that it supports the associated key 4 from below, a plurality of return springs 7 (only one of which is shown in FIG. 3A) each connected to a predetermined site of an associated one of the linkages 6 and configured to return the associated key 4, which is depressed, to a key-released state, and an electronic printed circuit board 8 including a plurality of switches 8*a* (only one of which is shown in FIG. 3A) for detecting key depression information of the associated key 4.

The key 4 is formed by a molded article e.g. of a synthetic resin and has a shape extending in the front-rear direction over a predetermined length. For example, the key 4 has a length (e.g. 15 cm) which is approximately half the length of a key of a general grand piano from the front end thereof to a balance rail pin about which the key swings. Further, the key 4 has an actuator 4*c* provided at a predetermined location, which extends downward from the key 4 over a predetermined length and is configured to press the associated switch 8*a* from above.

The linkage 6 is comprised of a front vertical link bar 11 vertically extending downward over a predetermined length from the front portion (right portion as viewed in FIG. 3A) of the key 4 at a predetermined location, a rear vertical link bar 12 vertically extending downward over a predetermined length from the rear portion (left portion as viewed in FIG. 3A) of the key 4 at a predetermined location, a front connection link bar 13 connected to the front vertical link bar 11, and a rear connection link bar 14 connected to the rear vertical link bar 12, and the front connection link bar 13 and the rear connection link bar 14 are connected to each other. Further, the front connection link bar 13 and the rear connection link bar 14 are pivotally supported by a front support part 16 and a rear support part 17 fixed on a spacer 9 on the bottom board 5*a*, respectively.

The front connection link bar 13 extends in the front-rear direction over a predetermined length, and first and second connection pins 21 and 22 are loosely inserted in respective pin holes formed in the front end of the front connection link bar 13 and a longitudinal central portion of the same, respectively. The two connection pins 21 and 22 are fixed to the front vertical link bar 11 and the front support part 16, respectively. Further, in the front connection link bar 13, a mounting hole 13*a* (predetermined site) for connecting the upper end of the return spring 7 to the front connection link bar 13 is formed at a location immediately rearward (leftward as viewed in FIG. 3A) of the pin hole in which the second connection pin 22 is loosely inserted. Furthermore, the front connection link bar 13 has a rear end thereof formed with a slot for loose insertion of a third connection pin 23, and the third connection pin 23 is fixedly inserted in a pin hole formed in the front end of the rear connection link bar 14.

On the other hand, the rear connection link bar 14 extends in the front-rear direction and has a length which is approximately half the length of the front connection link bar 13. Further, the rear connection link bar 14 has not only the pin hole formed in the front end thereof, but also a slot and a pin hole formed in the central portion and the rear end thereof, respectively, and fourth and fifth connection pins 24 and 25 are loosely inserted in the slot and the pin hole, respectively. The two connection pins 24 and 25 are fixed to the rear support part 17 and the rear vertical link bar 12, respectively.

Between the front support part 16 and the rear support part 17 on the spacer 9, there is erected a stopper 18. In the key-released state, a junction between the front connection link bar 13 and the rear connection link bar 14 is held in contact with the stopper 18 from above.

Further, the return spring 7 is formed by a vertically extending tensile coil spring and has an upper end thereof hooked in the mounting hole 13*a* of the front connection link bar 13 and a lower end thereof connected to the upper end of a swivel 32 of a tensile force adjustment mechanism 31, described hereinafter.

With the above-described construction of the linkage 6, when the key 4 is depressed, the key 4 and the linkage 6 operate as follows: When a player or the like presses down the front end of a key 4 with his/her finger, as indicated by a white arrow in FIG. 3B, the front vertical link bar 11 and the rear vertical link bar 12 of the key 4 move downward in unison with the key 4, whereby the front connection link bar 13 pivotally moves clockwise, as viewed in FIGS. 3A and 3B, about the second connection pin 22 against the urging force of the return spring 7. Further, in accordance with the pivotal motion of the front connection link bar 13, the front end of the rear connection link bar 14 connected to the rear end of the front connection link bar 13 via the third connection pin 23 moves upward. As a consequence, the rear connection link bar 14 pivotally moves counterclockwise, as viewed in FIGS. 3A and 3B, about the fourth connection pin 24. Then, in accordance with the pivotal motion of the rear connection link bar 14, the rear vertical link bar 12 connected to the rear end of the rear connection link bar 14 via the fifth connection pin 25 is pulled down, whereby the rear end of the key 4 moves downward.

Figure 3B:
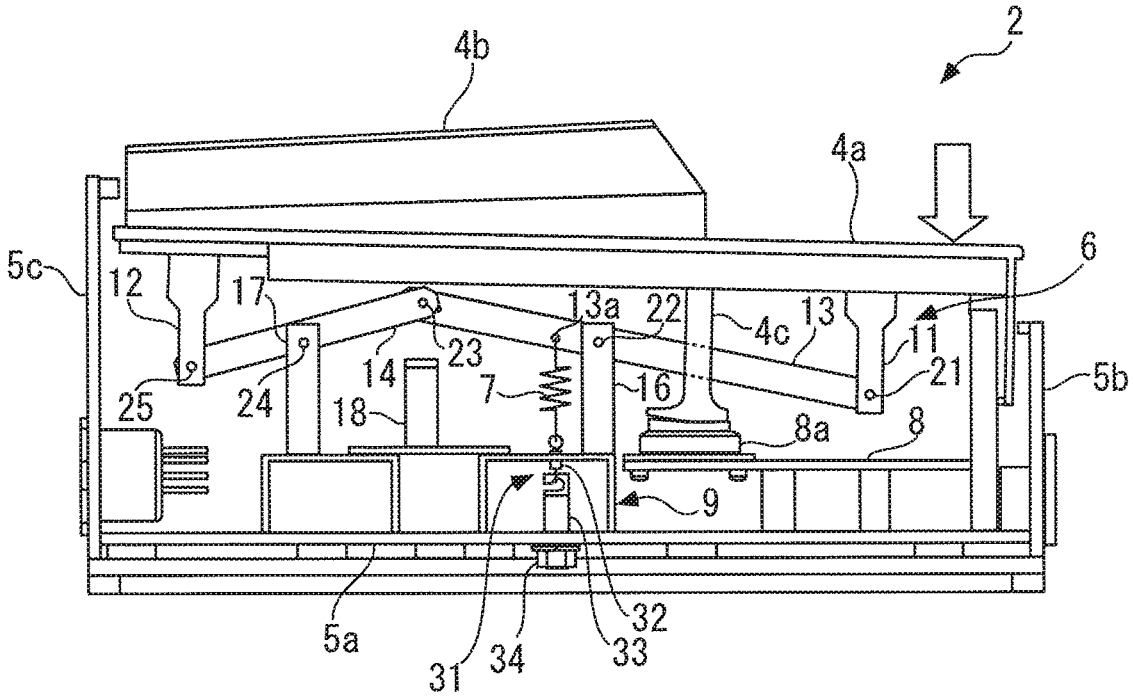
FIG. 3B is a side view of the keyboard unit in a key-depressed state.

Thus, when the key 4 is depressed and the front end of the key 4 (white key 4*a*) reaches its lowest position as shown in FIG. 3B, the front end of the key 4 is positioned lower by a predetermined distance (e.g. 10 mm) than in the key-released state shown in FIG. 3A, and the rear end of the same is positioned lower by a predetermined distance (e.g. 5 mm) which is approximately half the above-mentioned predetermined distance.

On the other hand, when the depressed key 4 is released, the front connection link bar 13 of the linkage 6 is pivotally moved by the urging force of the adjustment spring 7 in a direction opposite to the above-mentioned direction, and in accordance with this pivotal motion of the front connection link bar 13, the rear connection link bar 14 also pivotally moves in a direction opposite to the above-mentioned direction. Then, the junction between the rear end of the front connection link bar 13 and the front end of the rear connection link bar 14 comes into abutment with the stopper 18 from above, whereby further pivotal motion of each of the two connection link bars 13 and 14 is inhibited. With the above-described operation of the linkage 6, the key 4 moves upward and returns to its original key-released state.

Further, the keyboard device 1 has the tensile force adjustment mechanisms 31 provided in association with the respective keys 4 and each configured to adjust the tensile force of the associated return spring 7, which makes it possible to adjust the touch weight of the key 4 supported by the linkage 6 to which the return spring 7 is connected. Thus, the return spring 7 and the tensile force adjustment mechanism 31 form the touch weight adjustment mechanism, denoted by reference numeral 30, of the present invention.

Figure 4:
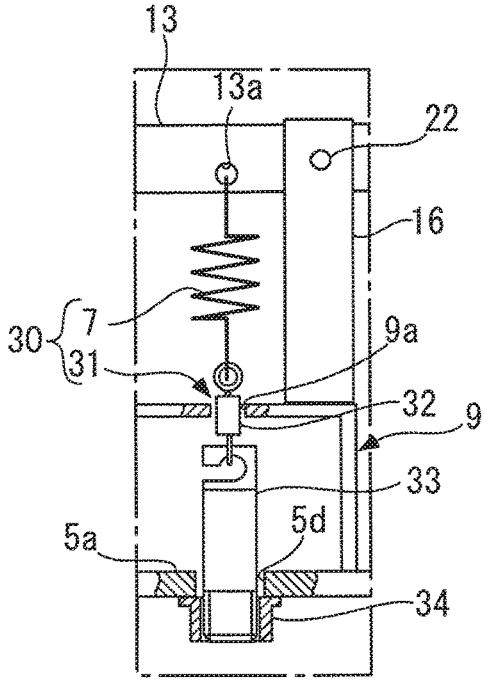
FIG. 4 is an enlarged view, partially broken away, of the touch weight adjustment mechanism (a return spring and a tensile force adjustment mechanism) appearing in FIG. 3A and components associated therewith.
Figure 5:
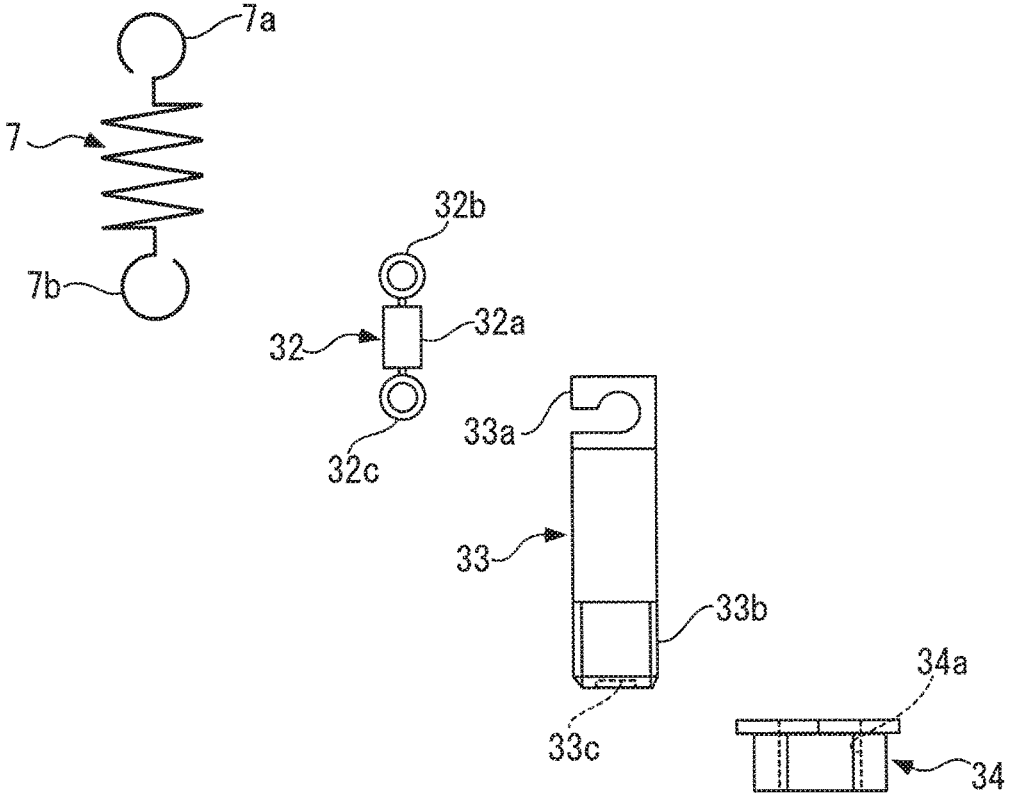
FIG. 5 is an exploded view of the touch weight adjustment mechanism.

FIG. 4 shows the return spring 7 and the tensile force adjustment mechanism 31, appearing in FIG. 3A, and components associated therewith, in a partially broken away state, on an enlarged scale, and FIG. 5 shows the touch weight adjustment mechanism 30 in an exploded state. As shown in FIGS. 4 and 5, the touch weight adjustment mechanism 30 is comprised of the return spring 7, the swivel 32 (rotary connection member) connected to the lower end of the return spring 7, an adjustment shaft 33 extending vertically over a predetermined length and connected to the lower end of the swivel 32, and a nut 34 provided on the lower side of the bottom board 5*a* of the unit case 5 and screwed onto the lower end of the adjustment shaft 33.

As shown in FIG. 5, the upper and lower ends of the return spring 7 are formed with respective arcuate hooks 7*a* and 7*b*. The upper hook 7*a* is hooked to the mounting hole 13*a* of the front connection link bar 13, while the lower hook 7*b* is hooked to an upper link part 32*b*, referred to hereinafter, of the swivel 32.

The swivel 32 is comprised of a hollow cylindrical barrel part 32*a*, and the upper link part 32*b* (spring-side connecting portion) and a lower link part 32*c* (shaft-side connecting portion) rotatably connected to the respective upper and lower ends of the barrel part 32*a*. Thus, the swivel 32 has the upper link part 32*b* and the lower link part 32*c* thereof configured to be rotatable relative to each other. Hooked to the lower link part 32*c* of the swivel 32 is a hook portion 33*a*, referred to hereinafter, of the adjustment shaft 33. The swivel 32 is loosely inserted through a hole 9*a* formed through an upper board portion of the spacer 9.

The adjustment shaft 33 extends vertically over a predetermined length, and has the hook portion 33*a* formed at an upper end thereof and a male screw 33*b* formed on the outer peripheral surface of the lower portion thereof. Further, the adjustment shaft 33 has an engaging groove 33*c* (engaging portion) formed on a lower end face thereof, for engagement with a predetermined tool (e.g. a screwdriver) that is used to operate the adjustment shaft 33 for rotation. The adjustment shaft 33 is loosely inserted through a through hole 5*d* of the bottom board 5*a* of the unit case 5, as shown in FIG. 4, and the male screw 33*b* formed on the lower portion of the adjustment shaft 33 is screwed into the nut 34 disposed on the outside of the bottom board 5*a*.

The nut 34 is formed by a flanged hexagonal nut, and has a female screw 34*a* formed in an inner peripheral surface thereof, for being screwed onto the male screw 33*b* of the adjustment shaft 33. The flange of the nut 34 has an outer diameter which is larger than the diameter of the through hole 5*d* of the bottom board 5*a*. With this, in a state in which the nut 34 is screwed onto the male screw 33*b* of the adjustment shaft 33 inserted through the through hole 5*d* of the bottom board 5*a*, the flange of the nut 34 is held in contact with the bottom surface of the bottom board 5*a* from below.

Figure 6:
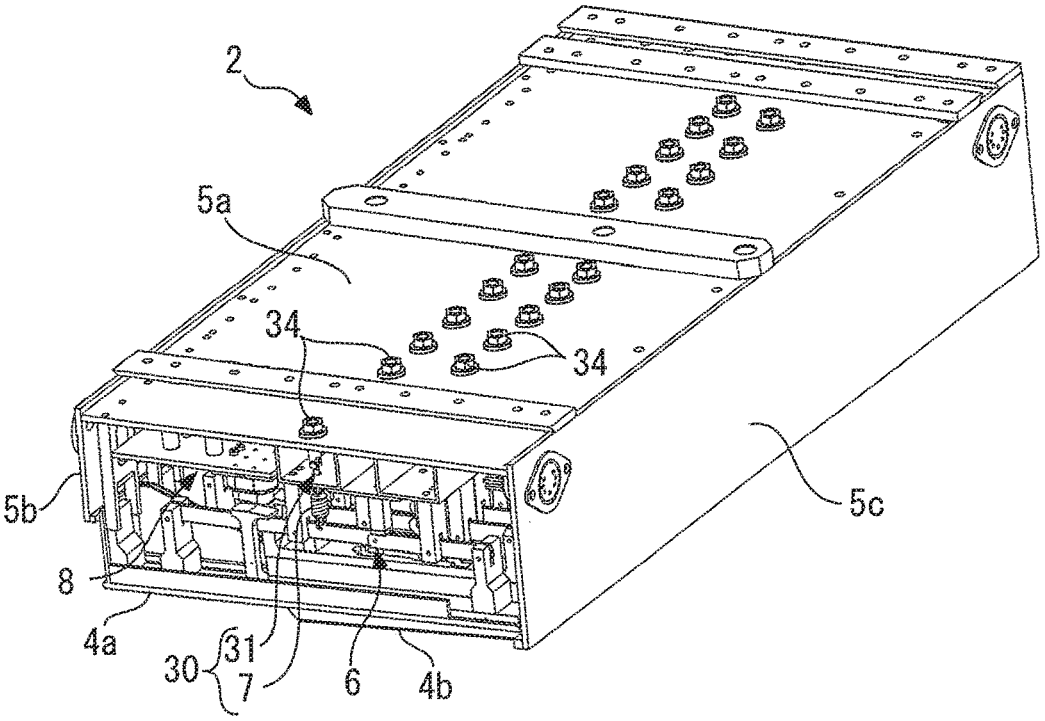
FIG. 6 is a perspective view of the keyboard unit in a vertically inverted state.

Next, a description will be given, with reference to FIGS. 6, 7A, and 7B, of a method of adjusting the touch weight of each key 4 of the keyboard device 1. First, the keyboard unit 2 including a key 4 whose touch weight is to be adjusted is vertically inverted as shown e.g. in FIG. 6. When the keyboard unit 2 is inverted, the nuts 34, which are associated with the white keys 4*a* and the black keys 4*b* of the respective touch weight adjustment mechanisms 30, are placed in a state exposed on the bottom board 5*a* as shown in FIG. 6. Then, in a state in which the nut 34 of one of the touch weight adjustment mechanisms 30 associated with the key 4 whose touch weight is to be adjusted is held by a hexagonal wrench or the like, and a tool, such as a screwdriver, is held in engagement with the engaging groove 33*c* of the adjustment shaft 33, the tool is turned. As a consequence, the adjustment shaft 33 in screwed engagement with the nut 34 is moved vertically while being rotated.

Figure 7A:
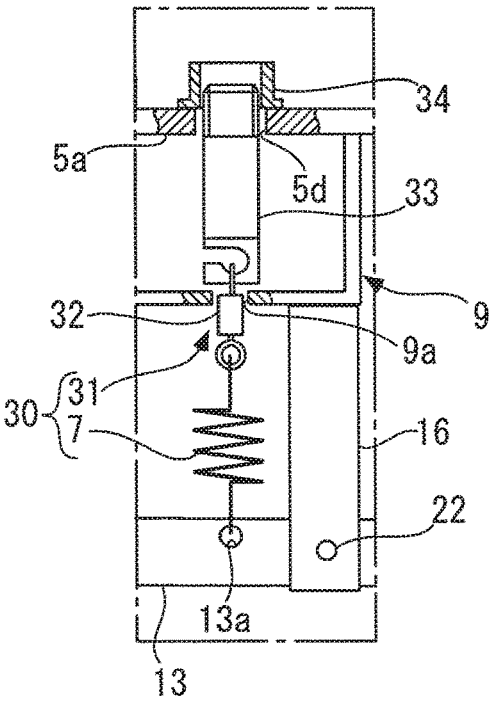

FIG. 7A shows a state in which the adjustment shaft 33 has been moved in an inward direction (downward as viewed in FIG. 7A) within the unit case 5. In this case, as the adjustment shaft 33 is moved, the stretch of the return spring 7 connected to the adjustment shaft 33 via the swivel 32 is reduced. Accordingly, the tensile force of the return spring 7 is reduced, resulting in a decrease in an urging force that acts downward on the predetermined site of the front link bar 13 of the linkage 6, more specifically, a portion to which the upper hook 7*a* of the return spring 7 is hooked (i.e. the mounting hole 13*a*), so that the touch weight of the associated key 4 becomes smaller than before the adjustment.

Figure 7B:
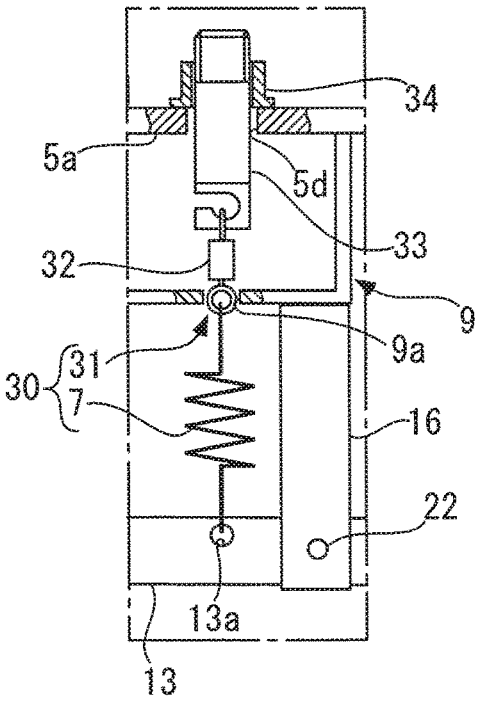

On the other hand, FIG. 7B shows a state in which the adjustment shaft 33 has been moved in an outward direction (upward as viewed in FIG. 7B) within the unit case 5. In this case, as the adjustment shaft 33 is moved, the stretch of the return spring 7 is increased. Accordingly, the tensile force of the return spring 7 is increased, resulting in an increase in the urging force that acts downward on the predetermined site of the front link bar 13 of the linkage 6, so that the touch weight of the associated key 4 becomes larger than before the adjustment.

As described above in detail, according to the present embodiment, the upper end of the return spring 7 formed by the tensile coil spring is connected to the predetermined site of the front link bar 13 of the linkage 6, whereas the lower end of the same is connected, via the swivel 32, to the upper end of the adjustment shaft 33 which is vertically movable by being rotated. When adjusting the touch weight of a key 4, by vertically moving the associated adjustment shaft 33 by rotating the same as described above, it is possible to adjust the touch weight of the key 4 with ease. Further, the return spring 7 and the adjustment shaft 33 are connected to each other via the swivel 32, so that even when the adjustment shaft 33 is operated for rotation, the rotational motion of the adjustment shaft 33 is not transmitted to the return spring 7, so that the tensile force of the return spring 7 can be adjusted appropriately. As described above, according to the present embodiment, it is possible to easily and appropriately adjust the touch weight of the key 4 by using the return spring 7 formed by a coil spring and changing the urging force of the same.

Further, the keyboard device 1 of the present embodiment is formed by a plurality of keyboard units 2 separable from each other, and hence when adjusting the touch weight of each key 4, by vertically inverting a desired one of the keyboard units 2, it is possible to operate the adjustment shafts 33 of the keyboard unit 2 in the inverted state, for rotation from above. This makes it possible to achieve work for touch weight adjustment with relative ease.

Figure 8A:
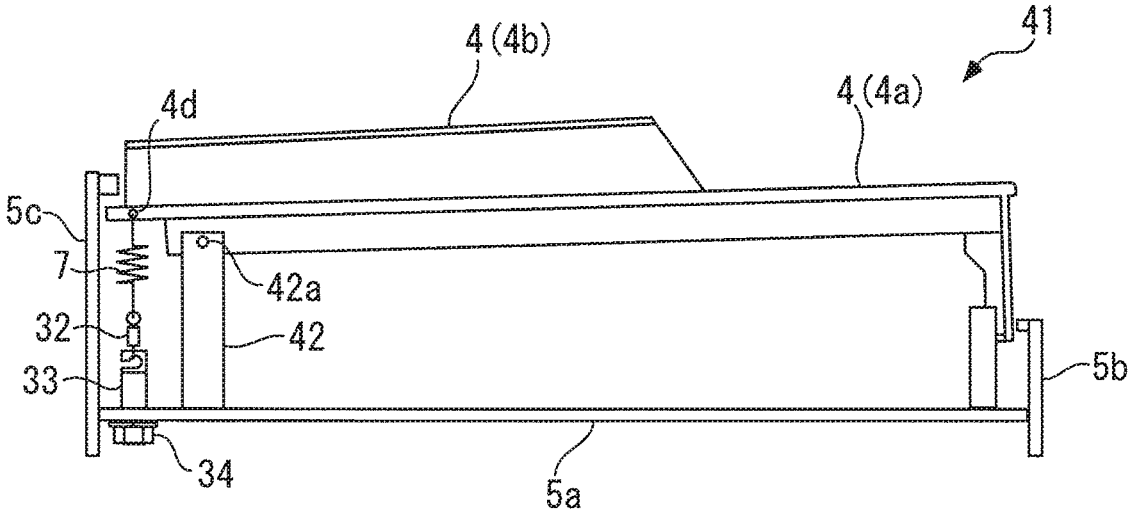
FIG. 8A is a side view of a keyboard device to which is applied a touch weight adjustment mechanism according to another embodiment of the present invention.

FIG. 8A shows a keyboard device to which is applied a touch weight adjustment mechanism according to another embodiment of the present invention. In this keyboard device 41, each of the keys 4 is not supported by the linkage 6, but has its rear end pivotally supported. Note that in the following description, the same components as those of the above-described keyboard device 1 are denoted by the same reference numerals.

Figure 8B:
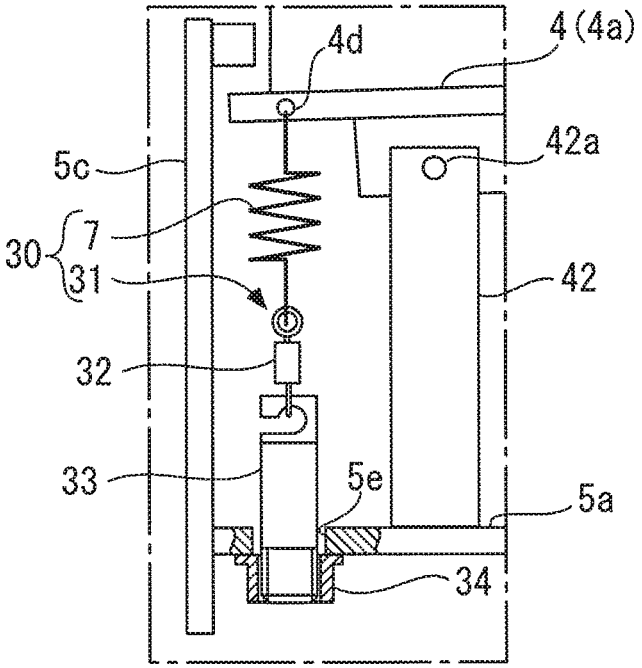
FIG. 8B is an enlarged view, partially broken away, of the touch weight adjustment mechanism appearing in FIG. 8A and components associated therewith.

As shown in FIG. 8A, in the keyboard device 41, the key 4 is supported by a pivotal motion support part 42 erected on the rear portion of the bottom board 5*a*, such that the key 4 is pivotally movable about a pivot shaft 42*a* (pivot). Further, on the rear end of the key 4, there is provided a touch weight adjustment mechanism 30 constructed similar to that of the above-described embodiment. Specifically, as shown in FIG. 8B, the upper end of the return spring 7 is hooked in a mounting hole 4*d* formed in the key 4 at a location rearward of the pivot shaft 42*a*. Further, the adjustment shaft 33 extends through a through hole 5*e* of the bottom board 5*a*, with its lower end screwed into the nut 34. The lower end of the return spring 7 and the upper end of the adjustment shaft 33 are connected to each other via the swivel 32.

In the keyboard device 41 constructed as above, a predetermined site (mounting hole 4*d*) of the key 4, which is located rearward of the pivot shaft 42*a*, is urged downward by the return spring 7. For this reason, the touch weight felt when the front end of the key 4 is pressed down changes according to the magnitude of the tensile force of the return spring 7. Therefore, similar to the embodiment described hereinbefore, by vertically moving the adjustment shaft 33 by rotating the same, it is possible to easily and appropriately adjust the touch weight of each key 4 in the keyboard device 41.

Note that the present invention is not limited to the above-described embodiments, but it can be practiced in various forms. For example, although in the above-described embodiment, the touch weight adjustment mechanism 30 is constructed such that the adjustment shaft 33 is screwed into the nut 34 provided on the lower side of the bottom board 5*a*, it is possible to form a screw hole in the bottom board 5*a* and screw the lower portion of the adjustment shaft 33 into the screw hole. Further, although in the above-described embodiments, the swivel 32 is used to connect the return spring 7 and the adjustment shaft 33, this is not limitative, but insofar as the return spring 7 and the adjustment shaft 33 can be connected in a state in which the rotational motion of the adjustment shaft 33 is prevented from being transmitted to the return spring 7, it is possible to employ any suitable rotary connection member, in place of the swivel 32. Furthermore, the swivel 32 may be integrally formed with the return spring 7 or the adjustment shaft 33. Also, although in the above-described embodiments, the return spring 7, the swivel 32, and the adjustment shaft 33 of the touch weight adjustment mechanism 30 are arranged along a vertical line, this is not limitative, but, for example, the components including the return spring 7 may be arranged in a state inclined with respect to the vertical line or in a horizontal state.

Although in the above-described embodiments, the touch weight adjustment mechanism 30 of the present invention is applied to the keyboard device 1 (41) formed by the plurality of keyboard units 2 which are separable from each other, as a matter of course, the present invention can be applied to a general keyboard device which cannot be separated. The details of the structure of each of the keyboard device 1 (41), the linkage 6, and the touch weight adjustment mechanism 30 are described only by way of example, and they can be changed, as desired, within the scope of the subject matter of the present invention.

It is further understood by those skilled in the art that the foregoing are preferred embodiments of the invention, and that various changes and modifications may be made without departing from the spirit and scope thereof.

What is claimed is:

1. A touch weight adjustment mechanism for a keyboard device including a plurality of keys, which is configured to adjust touch weight of an associated one of the keys, comprising:

an adjustment spring formed by a coil spring and configured to cause a tensile force thereof to act on the key, thereby increasing the touch weight of the key;

an adjustment shaft formed in a rod shape and configured to be movable in a lengthwise direction thereof by being operated for rotation; and a rotary connection member provided so as to connect between one end of the adjustment spring and one end of the adjustment shaft, which are closest to each other, and configured such that a spring-side connecting portion thereof connected to the adjustment spring and a shaft-side connecting portion thereof connected to the adjustment shaft are rotatable relative to each other.

2. The touch weight adjustment mechanism according to claim 1, wherein in the keyboard device, each of the keys is supported above a base via a predetermined linkage from below and is configured to be vertically movable, wherein the adjustment spring extends vertically and has an upper end thereof connected to a predetermined site of the linkage, the adjustment spring being configured to urge the predetermined site downward in accordance with depression of the key to thereby increase the touch weight of the key supported by the linkage, wherein the adjustment shaft extends vertically and is disposed in a state inserted vertically through the base, the adjustment shaft being configured to be vertically movable by having a portion thereof protruding outward from the base, operated for rotation, and wherein the rotary connection member connects between a lower end of the adjustment spring and an upper end of the adjustment shaft.

3. The touch weight adjustment mechanism according to claim 2, wherein the adjustment shaft is loosely inserted through a through hole formed in the base and has a male screw formed on an outer peripheral surface of a lower portion thereof and an engaging portion, with which a tool for rotating operation can be engaged, formed on a lower end thereof, and the touch weight adjustment mechanism further comprising a nut disposed on an outside of the base for engagement with the male screw of the adjustment shaft.

4. The touch weight adjustment mechanism according to claim 2, wherein the adjustment shaft has a male screw formed on an outer peripheral surface thereof and screwed in a screw hole formed in the base, and has an engaging portion, with which a tool for rotating operation can be engaged, formed on a lower end thereof.

5. The touch weight adjustment mechanism according to claim 1, wherein the rotary connection member is formed by a swivel.

6. The touch weight adjustment mechanism according to claim 1, wherein the keyboard device is formed by a plurality of keyboard units each of which has a predetermined number of keys included in the plurality of keys and which are configured to be separable from each other.

7. The touch weight adjustment mechanism according to claim 1, wherein in the keyboard device, each of the keys extends above a base in a front-rear direction and is configured to be pivotally movable about a predetermined location in a lengthwise direction thereof as a pivot, wherein the adjustment spring extends vertically and has an upper end thereof connected to a predetermined site of the key, located rearward of the pivot, the adjustment spring being configured to urge the predetermined site downward in accordance with depression of the key to thereby increase the touch weight of the key, wherein the adjustment shaft extends vertically and is disposed in a state inserted vertically through the base, the adjustment shaft being configured to be vertically movable by having a portion thereof protruding outward from the base, operated for rotation, and wherein the rotary connection member connects between a lower end of the adjustment spring and an upper end of the adjustment shaft.

* * * * *